US005344140A

United States Patent [19]

Anderson

[11] Patent Number: 5,344,140

[45] **Date of Patent: * Sep. 6, 1994**

[54] GOLF CLUB HEAD AND METHOD OF FORMING SAME

[75] Inventor: Donald A. Anderson, 6600 Werner Ave., #150, Huntington Beach, Calif. 92649

[73] Assignees: Donald A. Anderson, Huntington Beach; Donald J. C. Sun, San Diego, both of Calif. ; a part interest

[ * ] Notice: The portion of the term of this patent subsequent to Jun. 18, 2008 has been disclaimed.

[21] Appl. No.: 997,161

[22] Filed: Dec. 28, 1992

Related U.S. Application Data

[63] Continuation-in-part of Ser. No. 806,348, Dec. 13, 1991, Pat. No. 5,261,663, which is a continuation-in-part of Ser. No. 549,973, Jul. 9, 1990, Pat. No. 5,094,383, which is a continuation-in-part of Ser. No. 492,973, Mar. 13, 1990, Pat. No. 5,024,437, which is a continuation-in-part of Ser. No. 364,698, Jun. 12, 1989, abandoned.

[51] Int. Cl.[5] ..... A63B 53/04

[52] U.S. Cl. ..... 273/78; 273/173; 273/167 H; 273/167 J

[58] Field of Search ..... 273/167 R–77 A, 273/77 R, 78, 164.1, 193 R, 194 R, 162 R

[56] References Cited

U.S. PATENT DOCUMENTS

| | | |
|---|---|---|
| 1,257,471 | 2/1918 | Fitzjohn et al. . |
| 1,359,220 | 11/1920 | Beamer . |
| 1,463,533 | 7/1923 | Kurz . |
| 1,589,363 | 6/1926 | Butchart . |
| 1,665,523 | 4/1928 | Boyce . |
| 2,034,936 | 3/1936 | Barnhart . |
| 2,447,967 | 8/1948 | Stone . |
| 3,218,072 | 11/1965 | Burr . |
| 3,387,844 | 6/1968 | Shippee . |
| 3,970,236 | 7/1976 | Rogers . |
| 4,027,885 | 6/1977 | Rogers . |
| 4,252,262 | 2/1981 | Igarashi . |
| 4,398,965 | 8/1983 | Campau . |
| 4,432,549 | 2/1984 | Zebelean . |
| 4,438,931 | 3/1984 | Motomiya . |
| 4,465,221 | 8/1984 | Schmidt . |
| 4,534,558 | 8/1985 | Yoneyama . |
| 4,749,197 | 6/1988 | Orlowski . |
| 4,754,969 | 7/1988 | Kobayashi . |
| 4,768,787 | 9/1988 | Shira . |
| 4,792,140 | 12/1988 | Yamaguchi et al. . |
| 4,804,188 | 2/1989 | McKee et al. . |
| 4,809,978 | 3/1989 | Yamaguchi et al. . |
| 4,824,116 | 4/1989 | Nagamoto et al. . |
| 5,024,437 | 6/1991 | Anderson . |

FOREIGN PATENT DOCUMENTS

| | | |
|---|---|---|
| 211781 | 12/1957 | Australia . |
| 692134 | 6/1940 | Fed. Rep. of Germany . |
| 62-07474 | 9/1987 | Japan . |
| 6485679 | 3/1989 | Japan . |
| 3822 | of 1893 | United Kingdom . |
| 2248 | of 1894 | United Kingdom . |
| 15376 | of 1903 | United Kingdom . |
| 15260 | of 1905 | United Kingdom . |
| 243435 | 11/1925 | United Kingdom . |
| 267755 | 3/1927 | United Kingdom . |
| 379032 | 8/1932 | United Kingdom . |
| 442557 | 2/1936 | United Kingdom ..... 273/80 R |
| 1227948 | 4/1971 | United Kingdom . |
| 2146249 | 4/1985 | United Kingdom . |

OTHER PUBLICATIONS

Dennis, Larry "What Irons Are Best For You—Forged or Cast?", *Golf Digest,* Jan. 1975, pp. 40–46.

*Primary Examiner*—Vincent Millin
*Assistant Examiner*—Sebastiano Passaniti
*Attorney, Agent, or Firm*—William W. Haefliger

[57] ABSTRACT

A golf club head, comprising a main body portion formed by an investment casting of a first metallic material; a face plate formed of a second metallic material which is forged and is substantially softer than the first material; joining the periphery of the face plate to the main body portion to form a high strength, forged face plate for the golf club head, and the metallic materials for the face plate and main body portion being of substantially the same composition.

37 Claims, 6 Drawing Sheets

FIG. 8.
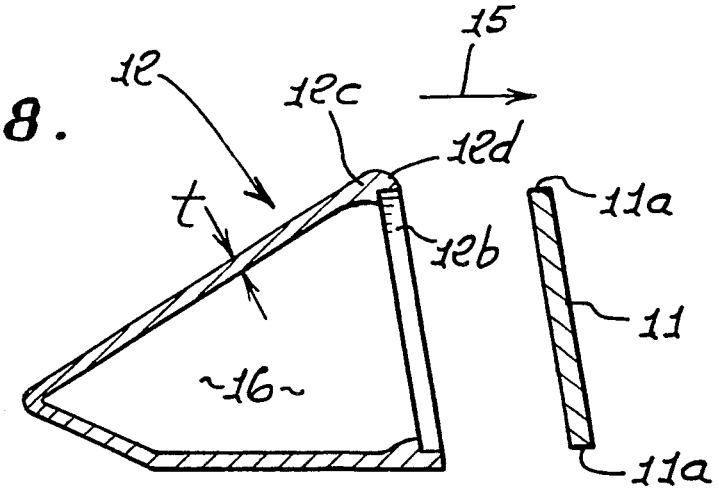
FIG. 9.
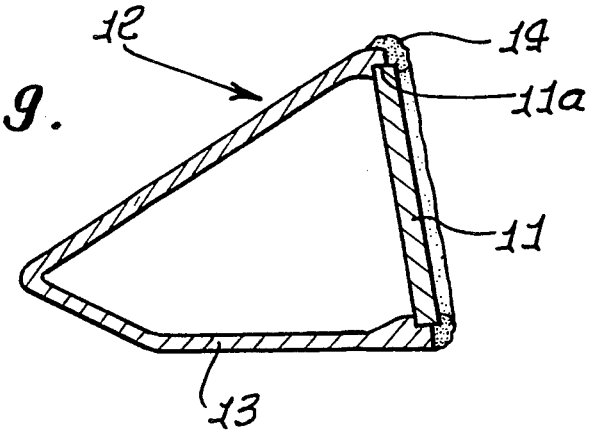
FIG. 10.
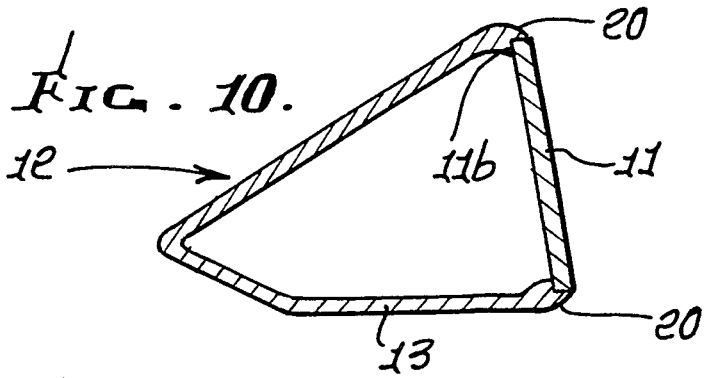
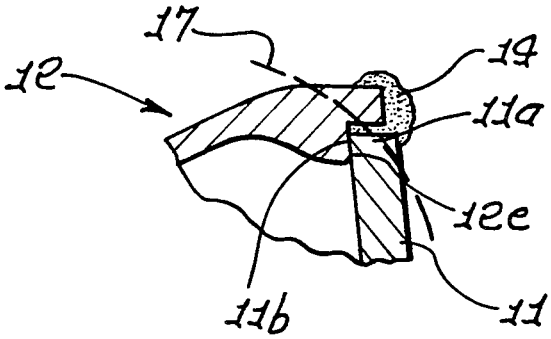
FIG. 11.

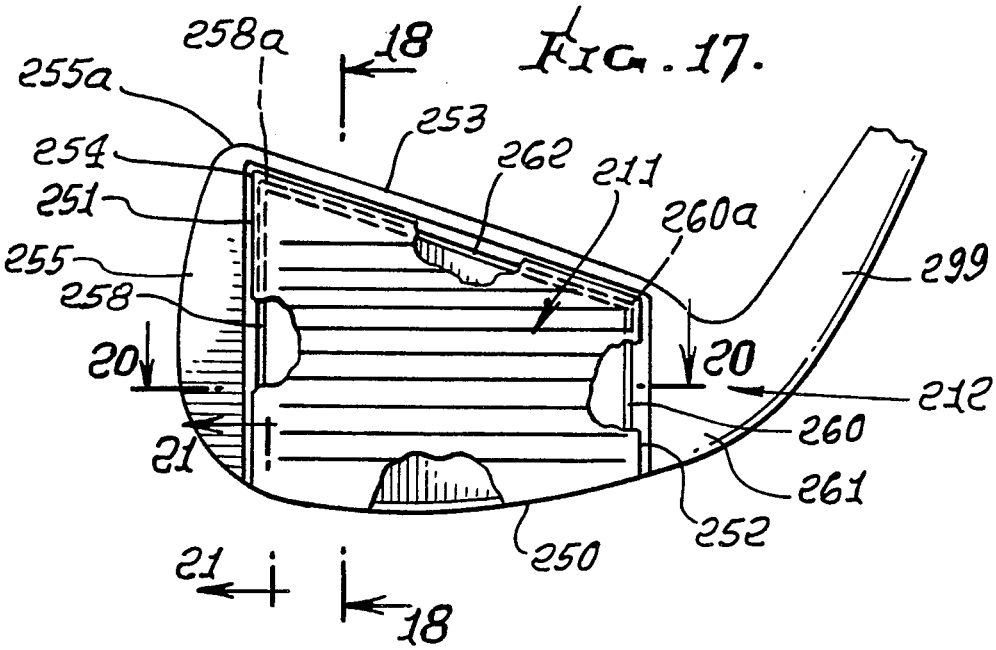
FIG. 17.
FIG. 18.
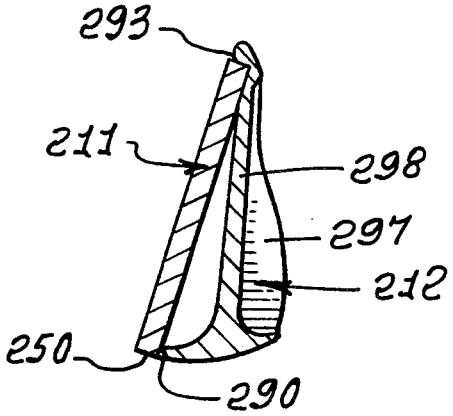
FIG. 19.
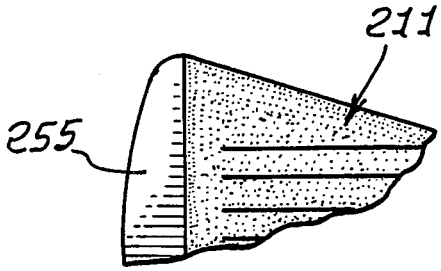
FIG. 20.
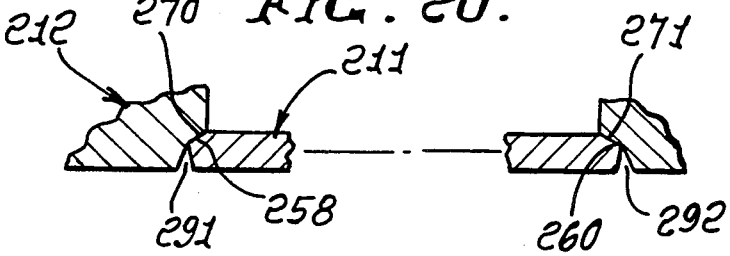
FIG. 21.
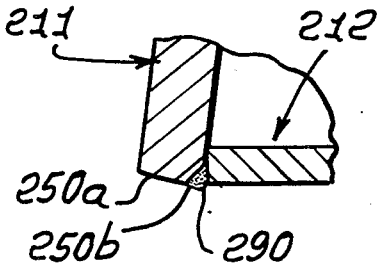

GOLF CLUB HEAD AND METHOD OF FORMING SAME

BACKGROUND OF THE INVENTION

This application is a continuation-in-part of Ser. No. 806,348, filed Dec. 13, 1991 now U.S. Pat. No. 5,261,663, which is a continuation-in-part of application Ser. No. 549,973, filed Jul. 9, 1990 now U.S. Pat. No. 5,094,383, which is a continuation-in-part of application Ser. No. 492,973 filed Mar. 13, 1990, now U.S. Pat. No. 5,024,437, which is a continuation-in-part of Ser. No. 364,698 filed Jun. 12, 1989 now abandoned.

This invention relates to golf clubs and more particularly to an improved face plate construction for a golf club head.

The heads of golf clubs are generally formed in a one-piece casting of durable materials, such as stainless steel, beryllium copper, aluminum, etc. A head of this type is described in U.S. Pat. No. 4,021,047 issued May 3, 1977, to R. J. Mader. The use of face plates made of a different material than that of the main body of the club head has been disclosed in the prior art in both irons and "wood"-type drivers, which are often made of cast metal. Such prior art club heads are described in U.S. Pat. No. 4,792,140 issued Dec. 20, 1988, to Yamaguchi et al.; U.S. Pat. No. 4,534,558 issued Aug. 13, 1985, to Yoneyama; U.S. Pat. No. 3,218,072 issued Nov. 16, 1965, to Burr; and British Patent No. 1.227.948 issued Apr. 15, 1971, to Haines et al. In the heads of all of these prior art patents, the face plate is of a plastic material, such as a resin or a carbon fiber composite. It has been found that the use of a forged metal for the face plate of the club head results in a stronger head and in a more solid impact with a golf ball and better "feel" which provides better ball flight control. However, forged metal is not amenable to casting, which mitigates against its use for forming the entire head. Also, forged metal tends to have a high density which would make for a club head having excessive weight.

SUMMARY OF THE INVENTION

The golf club head of the present invention provides an improvement over prior art heads in that it utilizes a face plate of forged metal. This end result is achieved without greatly increasing the cost or weight of the driving head by forming the main body of the head in an investment casting of a material such as stainless steel, beryllium copper, titanium, or aluminum, and then attaching a face plate of a forged metal selected from the class consisting of forged carbon steel, forged stainless steel, forged beryllium copper, and forged titanium, by suitable means such as welding.

It has been found that forged metal face plates have an inherently greater strength than cast metal face plates with a more uniform hardness over the hitting area of the plate. This is in view of the low porosity, high density and homogeneous grain structure of such a material which makes for a more solid plate. On the other hand, cast metal is desirable for the main body of the club head in view of its lighter weight, which tends to keep down the overall weight of the club head. It is essential that the face plate be solidly attached to the main body of the head by means such as welding to make for a solidly integrated head structure.

It is therefore an object of this invention to provide a golf club head having a face plate of a forged metal which gives more solid impact resistance and feel, to provide better control.

It is another object to provide a face plate that provides added heel and toe region weighting to a golf club, to enhance control of ball stroking; and it is an object to provide such a face plate that also consists of forged material.

Additional objects include provision of a tapering forged face plate on an iron club head; a forged face plate that extends to the bottom level of the head and forms the lowermost front edge portion of the head to strike the turf during golf ball striking movement of the head, and resist wear; an iron head having top and bottom walls, a heel and a toe, the face plate edges and welding looping characterized by at least one of the following and preferably all of the following:

i) extending i.e. projecting toward and closer to said top wall than to said toe ii) extending closer to said bottom wall than to said toe iii) extending closer to said top wall than to said heel iv) extending i.e. projecting toward and closer to said bottom wall than to said heel.

These and other objects and advantages of the invention, as well as the details of an illustrative embodiment, will be more fully understood from the following specification and drawings, in which:

DRAWING DESCRIPTION

FIGS. 8–10 are sections taken in elevation to show plate and head attachment;

FIG. 11 is an enlarged section showing welding and finishing;

Figure 1:
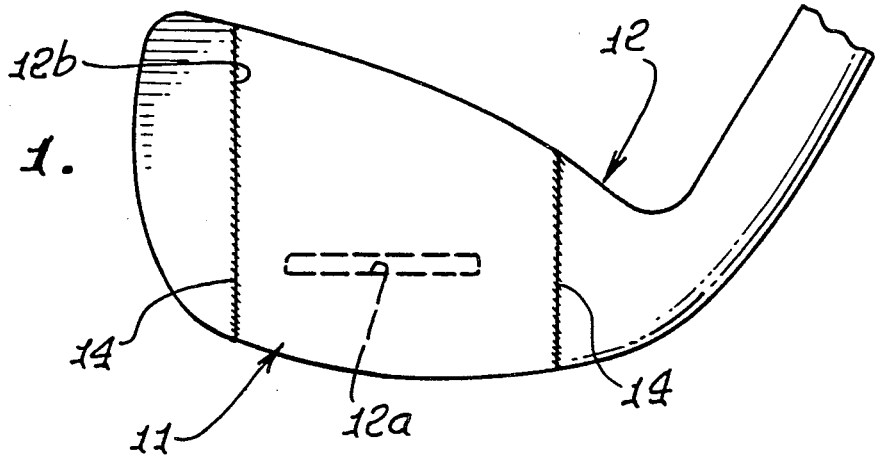
FIG. 1 is a side elevational view of a first embodiment of the invention.
Figure 2:
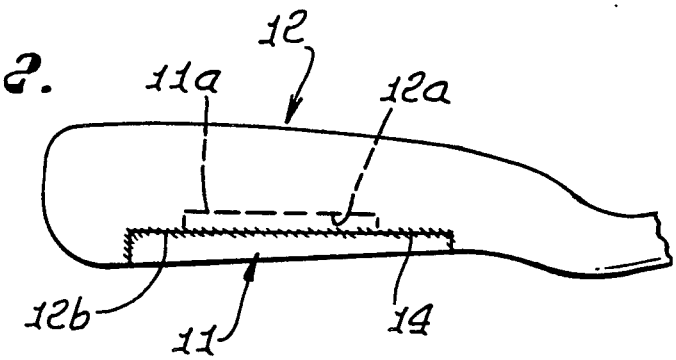
FIG. 2 is a bottom plan view of the first embodiment.
Figure 3:
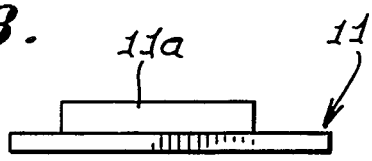
FIG. 3 is a top plan view illustrating the face plate employed in the first embodiment.
Figure 4:
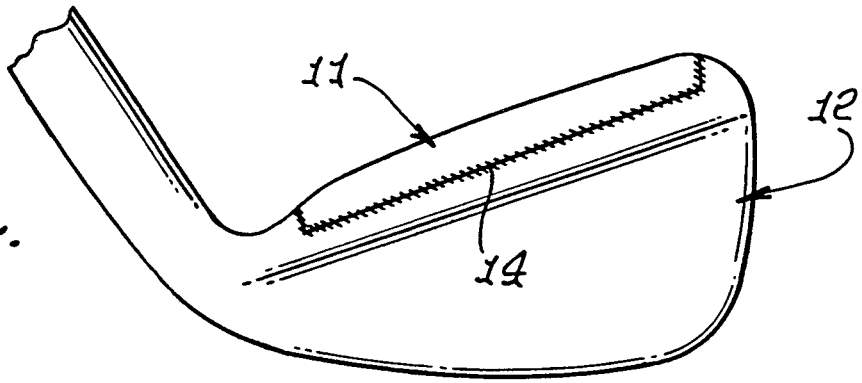
FIG. 4 is a top plan view of the first embodiment.
Figure 13:
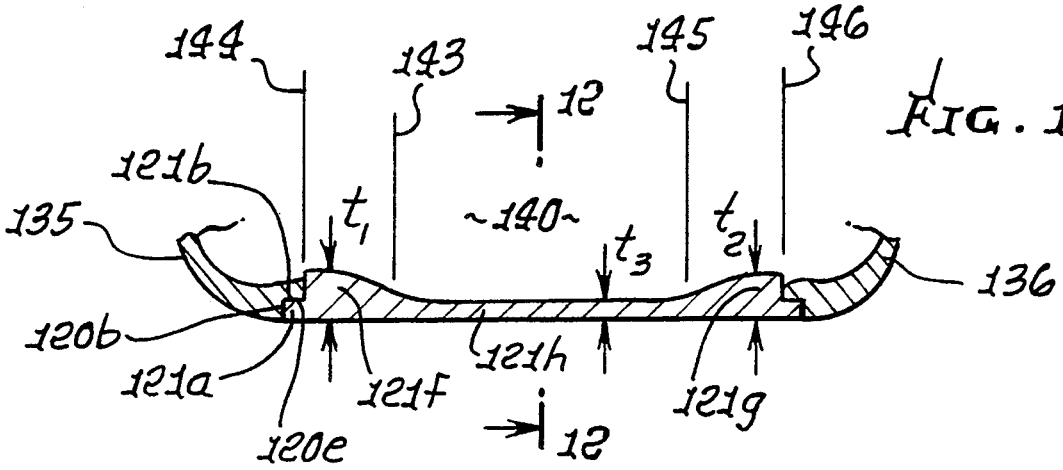
FIG. 13 is a section taken on lines 13—13 of FIG. 1.
Figure 15:
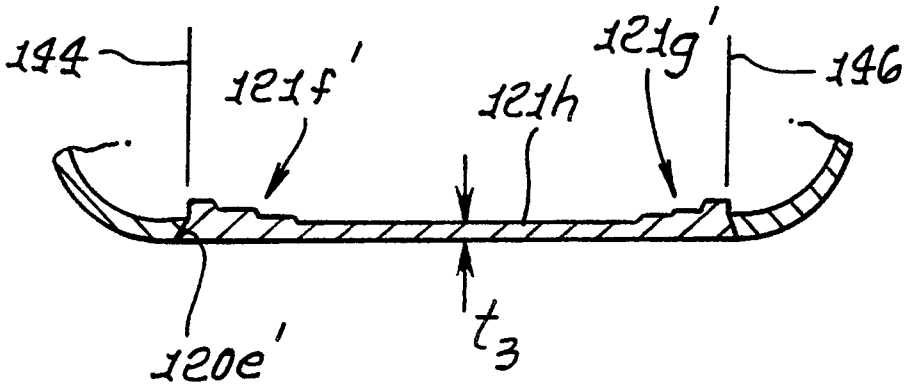
FIG. 15 is a view like FIG. 13 showing a modification.
Figure 15A:
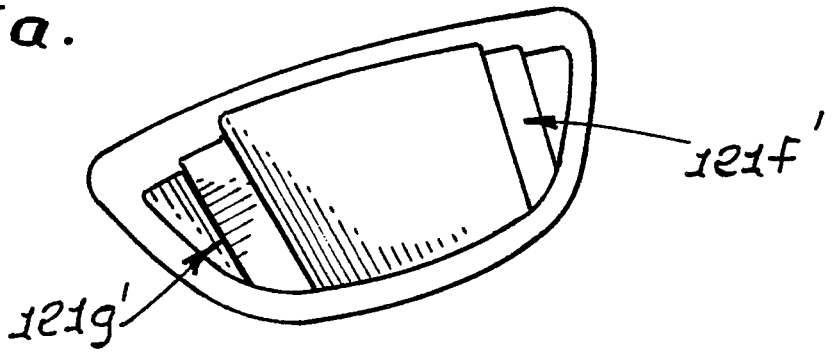
Figure 16:
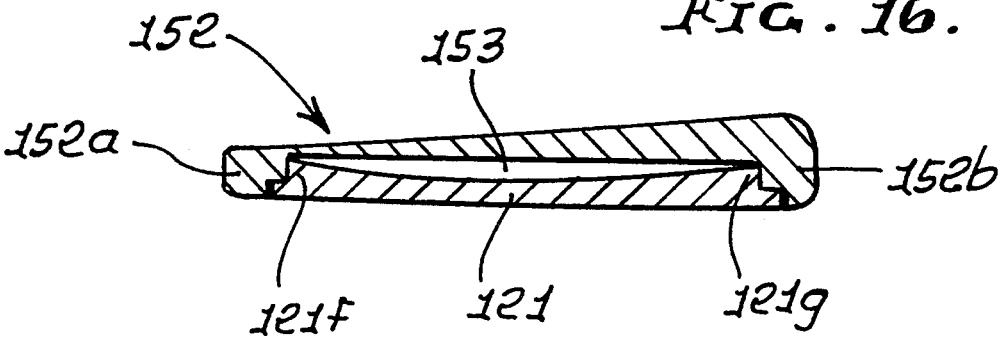

FIG. 15*a* is a perspective view of the FIG. 15 face plate;

FIG. 16 is a view like FIG. 13, showing an iron incorporating the invention;

FIG. 17 is a view like FIG. 1 showing a modification;

FIG. 18 is a section on lines 18—18 of FIG. 17;

FIG. 19 is a fragmentary view showing a completed head, in elevation;

FIG. 20 is a section on lines 20—20 of FIG. 17; and

FIG. 21 is an enlarged section on lines 21—21 of FIG. 17.

DETAILED DESCRIPTION

Referring to FIGS. 1–4, a first embodiment of the invention is illustrated. Face plate 11, which is fabricated of a material selected from the class consisting of forged carbon steel, forged stainless steel, forged beryllium copper, and forged titanium, has a lip portion 11*a* formed thereon. The main body 12 of the club head is formed by the investment casting of a material, such as stainless steel, beryllium copper, titanium, aluminum, etc. Main body portion 12 has a slot 12*a* formed therein and a recessed portion 12*b* which matingly receives face plate 11 with lip portion 11*a* fitting into slot 12*a*. Face plate 11 is solidly integrated with main body portion 12 by weld joints 14 formed along the perimeter of the face plate. In this manner, the face plate is solidly integrated with the casting.

Figure 5:
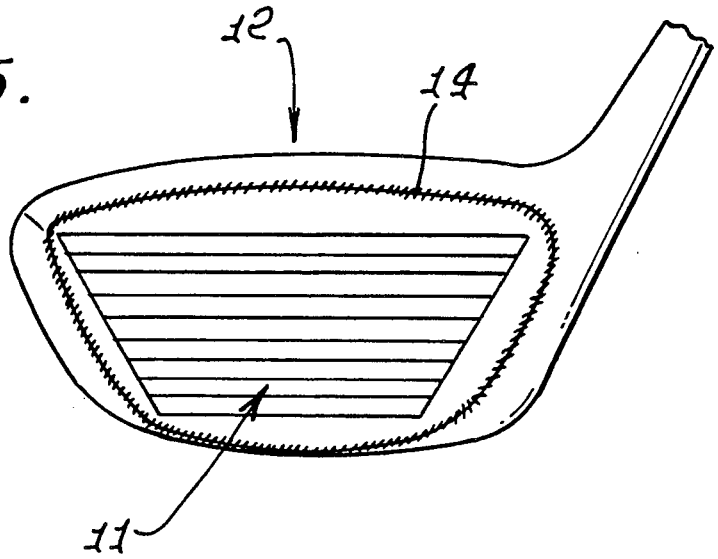
FIG. 5 is a side elevational view of a second embodiment of the invention.
Figure 6:
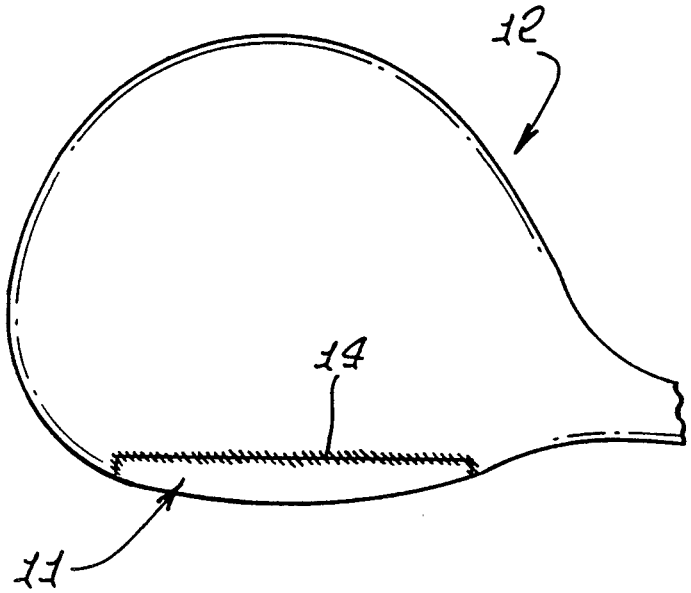
FIG. 6 is a bottom plan view of the second embodiment.
Figure 7:
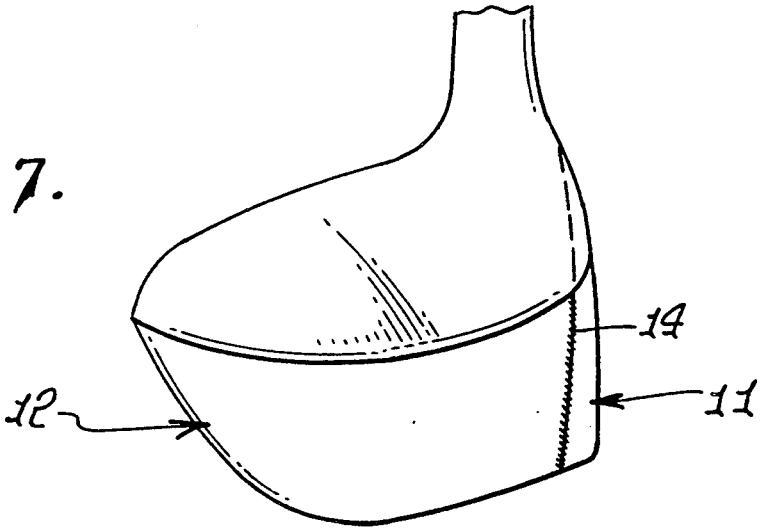
FIG. 7 is a front perspective view of the second embodiment.

Referring now to FIGS. 5–7, a second embodiment of the invention is illustrated, this embodiment being a "wood"-type driver. The main body portion 12, as for the previous embodiment, is formed by investment casting from a material such as stainless steel, beryllium copper, titanium, aluminum, etc. The face plate 11, as for the previous embodiment, is fabricated of forged metal selected from the same class of materials as for the first embodiment. The face plate 11 is abutted against the front surface of the casting and solidly joined thereto along weld joints 14, which run along the perimeter of the face plate thereby integrating the face plate with the casting.

For best results, both the head and the face plate consist of the same high strength material, i.e., stainless steel. One such steel is 17-4 PH forged stainless steel. This facilitates best weld connection of these parts and resistance to separation upon repeated sharp impacts with golf balls. See in this regard FIGS. 8–11, showing connection of these parts.

In FIG. 8, the peripheral slot 12*b* is shown formed in a thickened portion 12*c* of the cast stainless steel head which projects forwardly. See arrow 15. The slot and thickened portion 12*c* extend in a loop about the open end of the head, which is hollow at 16. Thickness "t" of the main wall extent of the head, rearward of 12*c*, is typically within the range 0.50 and 0.070 inches, except that the sole plate is typically between 0.085 and 0.100 inches. Head looping lip 12*d* overhangs the slot 12*b*, which is generally L-shaped in cross section. See FIG. 11.

FIG. 9 shows the forged stainless steel plate 11 looping periphery 11*a* closely fitted into the looping slot 12*b*; and FIG. 11 also shows this as well as the plate wall 11*b* abutting the looping ledge 12*e* which constitutes one wall of the slot.

FIG. 11 also shows weld material 14 applied to the elements 12*d* and 11*a*, and penetrating the clearance between 11*a* and 12*d*. After grinding, as along finish line 17, the looping peripheral edge of the head and plate is forwardly convexly rounded, as at 20 in FIG. 10, some weld material remaining, as in the clearance. A high strength, rigid connection is thereby effected between the high strength, compatible stainless steel elements 11 and 12, with element 11 being forged for extremely high strength and resistance to failure as by crack formation, and resistance to deformation, in use.

Forged plate 11 is preferably of uniform thickness, within the range 0.090 and 0.130 inches, and is thicker than sole plate 13.

The method of forming the high strength head includes the steps:

a) casting a golf club head main body consisting of metal, b) forging a golf club head face plate consisting of metal, c) weld connecting the forged face plate to the front of the head main body to conform to the front periphery of the body.

Further, the a) step typically includes forming a lip 12*d* at the periphery of the head main body, and the c) step includes weld connecting the periphery 11*a* of the forged face plate to the lip 12*d*; and including grinding the weld, the lip and the plate periphery to form a forwardly convex and smooth head surface bounding the periphery of the plate.

Figure 12:
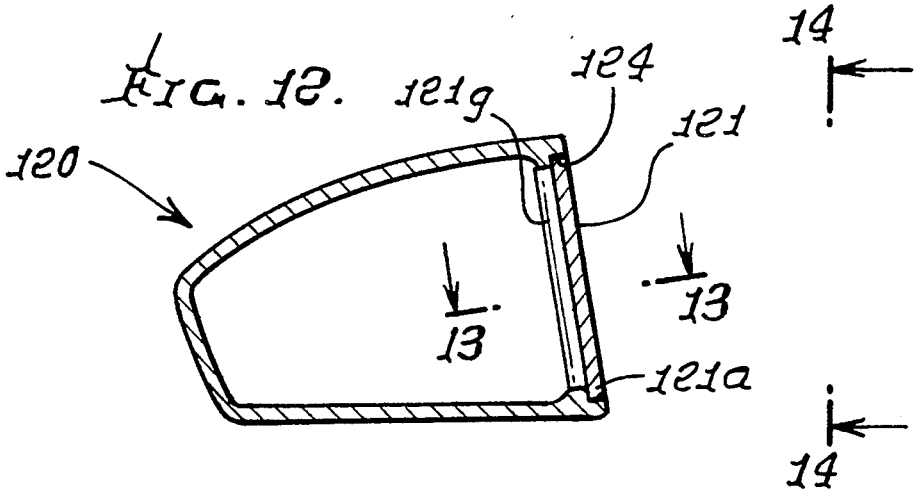
FIG. 12 is a vertical section taken through a metal wood head, showing another embodiment of the invention.
Figure 14:
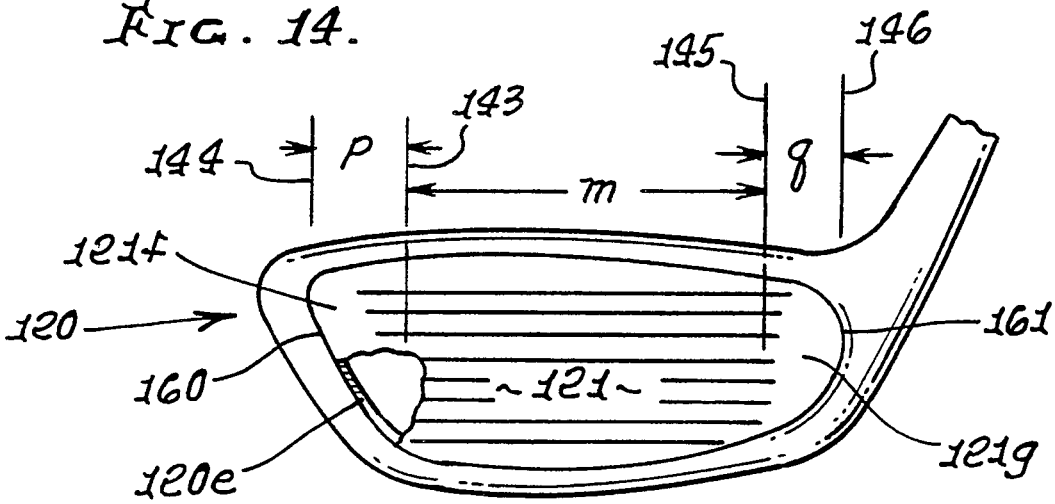
FIG. 14 is a front face view of the metal wood of FIG. 12, partly broken away.

Referring now to FIGS. 12–14, another embodiment of the invention is illustrated, i.e. a metal wood head having a main body portion 120 of a first metallic material. It may be formed of investment casting material such as stainless steel, beryllium copper, titanium, aluminum, etc. The face plate 121 is formed from a second metallic material, and is forged for high strength. Preferably, the face plate metal is the same as the main body metal, both typically consisting of stainless steel. The forged face plate 121 is peripherally abutted against a front ledge surface of the body (typically a casting), and solidly joined to the latter along weld joint 124, running along the looping peripheral portion of the face plate, integrating the face plate and body portion.

Thus, for example, the forged plate 121 has a looping periphery 121*a* fitting closely into the looping slot 120*b*, plate wall 121*b* abutting the looping ledge 120*e* which constitutes one wall of the slot. The fabrication including welding may be carried out as in FIG. 11, and its description, and a high strength failure resistant club head (metal wood) is thereby formed. The face plate 121 may have the looping peripheral shape of plate 11, and be upwardly convex; downwardly convex, and generally trapezoidal.

A feature of the invention is the provision of a face plate having first and second portions and an intermediate portion, the first and second portions of the face plate respectively located closer to said body toe and heel than the intermediate portion. In this regard, the plate first and second portions preferably have greater thickness than the intermediate portion. See first and second plate portions 121*f* and 121*g*, the former closest to the head toe 135; and the latter 121*g* closest to the head heel 136. FIG. 13 shows that the portions 121*f* and 121*g* both project toward the space 140 rearward of the plate; and FIG. 14 shows that portion 121*f* is located between front to rear planes 143 and 144, and portion 121*g* is located between front to rear planes 145 and 146. Plate intermediate portion 121*h* lies between planes 143 and 145 for example, and the lateral extent "m" of the intermediate portion 121*h* may be greater than each of the lateral extents "p" and "q" of the first and second plate portions 121*f* and 121*g*. Also, the intermediate portion 121*h* is centrally thinner than each of the portions 121*f* and 121*g*, whereby metal weight of the forged plate is "redistributed" toward the toe and heel of the face plate, and of the club head body, to resist twisting of the club head, and shaft, during impact and striking of a golf ball. As shown, the thickness $t_1$, of plate portion 121*f* progressively and smoothly increases toward plane 144; and the thickness $t_2$ of plate portion 121*g* progressively and smoothly increases toward plane 146. Welding 160 at the face plate toe, and 161 at the face plate heel also adds to toe and heel weighting effect.

FIG. 15 shows the same construction, except that the thickness of portion 121*f* increases as an upward stairstep 121*f'* toward plane 144; and the thickness of portion 121*g* increases as a stairstep 121*g'* toward plane 146. Intermediate portion 121*h* of the plate may have minimum thickness $t_3$ generally about midway between the increased thickness portions 121*f* and 121*g*; and $t_3$ may be between about 1 to 6 millimeters whereas $t_1$ and $t_2$ may each increase to about 4 to 8 millimeters, laterally. Other dimensions may be used. Looping ledge 120*e'* is slanted or tapered, as in a countersink, in FIG. 15. Other fastening methods (plate to head shell) may be employed.

In FIG. 16, a forged face plate 121 may be like that of FIG. 13, and be peripherally attached as by welding at 150 to a looping ledge 151 formed by iron head 152. Note plate weight "redistribution" at 121*f* and 121*g* toward the toe and heel 152*a* and 152*b* of the iron head, adding to "anti-twist" effect. Note recess 153 formed by the head body, and into which the thicker plate portions 121*f* and 121*g* project.

In the iron shown in FIG. 17, forged face plate 211 has the same composition as defined for face plate 11 in FIG. 1. The main body 212 of the head is a casting having the same composition as defined in body 12. Preferably, both 211 and 212 have the same metallic composition, such as steel, as for example stainless steel. The face plate 211 extends to the bottom level of the head, at 250, being downwardly convex at its lower edge, as seen in FIG. 17. FIG. 21 shows the face plate lower edge 250*a* forming the turf striking lowermost forward edge of the head, to resist wear. Welding 290 attaches the lowermost edge rear 250*b* to the main body lower edge 212*a*. The face plate 211 also extends upwardly between opposite parallel upright edges 251 and 252, toward the top level of the head indicated at 253. The uppermost extent of the face plate, i.e. edge 254 is substantially linear, but projects upwardly, toward the uppermost extent at 255*a* of the toe 255 end of the head. The face plate as shown is trapezoidal in outline or configuration, with top and bottom elongated edge extents, as described.

The main body 212 forms ledge means supporting peripheral portions of the face plate, inwardly of the plane defined by the ball striking front face of the face plate. Such ledge means includes a first ledge 258, seen in FIGS. 17 and 20, proximate the head toe 255, and extending upright from the bottom level of the head into proximity with the top level of the head.

A second ledge is seen at 260, proximate the head heel extent 261, and extending upright from the bottom level of the head into proximity with the top level of the head; and a third ledge 262 extends proximate the top level of the head and generally parallel thereto, and toward uppermost extents of ledges 258 and 260, at 258*a* and 260*a*. Ledges 258 and 260 extend in parallel relation, ledge 258 being substantially longer than ledge 260. Also all three ledges 258, 260 and 262 are beveled to form seating and centering surfaces for the face plate which has corresponding bevels, as at 270 and 271 seen in FIG. 20. Looping welding is provided at the gaps between the face plate periphery and the main body, as at 290–293. Weld stretch 290 is rearward of forged edge 250*a*, and is thus protected against direct frontal engagement with sand, rocks, etc. After welding, the head is ground, polished and surface treated to appear, for example, as seen in FIG. 19.

The looping welding and the looping edges of the face plate at which the welding formed, are characterized by at least one of the following, and preferably all of the following:

i) extending closer to said top wall than to said toe
ii) extending closer to said bottom wall than to said toe
iii) extending closer to said top wall than to said heel
iv) extending closer to said bottom wall than to said heel.

The head may have a cavity back at 297, and an upright wall 298. A hosel is provided at 299.

I claim:

1. A golf club head, comprising
a) a main body portion formed by an investment casting of a first metallic material,
b) a face plate formed of a second metallic material which is forged and is substantially softer than said first material,
c) means including extending in a loop and welding joining the periphery of the face plate to said main body portion to form a high strength, forged face plate for said golf club head,
d) the metallic materials for said face plate and main body portion being of substantially the same composition.

2. The club head of claim 1 wherein said head has a top wall, a bottom wall, a toe and a heel, and wherein there is a minimum gap between the loop and said top wall, and a minimum gap between the loop and the toe, the first mentioned minimum gap being the lesser of said gaps.

3. The club head of claim 1 wherein there is a minimum gap between the loop and bottom wall and a minimum gap between the loop and said heel, the first mentioned minimum gap being the lesser of said gaps.

4. The club head of claim 2 wherein there is also a minimum gap between the loop and said heel, and which is greater than said first mentioned minimum gap.

5. The club head of claim 3 wherein said minimum mad between the loop and said bottom wall is lesser than the minimum gap between said loop and the heel.

6. The club head of claim 2 wherein said loop also:
projects toward and closer to said bottom wall than to said toe
projects toward and closer to said top wall than to said heel
projects toward and closer to said bottom wall than to said heel.

7. The club head of claim 1 wherein said metallic materials for said forged face plate, and cast main body portion, consist essentially of steel.

8. The golf club head of claim 1 wherein said first and second ledges define beveled surfaces seating correspondingly beveled surfaces defined by the face plate.

9. The golf club head of claim 1 wherein the forged face plate extends to the bottom level of the head and defines a lowermost front edge portion of the head to strike the turf during golf ball striking movement of the head.

10. A golf club head, comprising
a) a main body portion formed by an investment casting of a first metallic material,
b) a face plate formed of a second metallic material which is forged and is substantially softer than said first material,
c) means joining the periphery of the face plate to said main body portion to form a high strength, forged face plate for said golf club head, d) the metallic materials for said face plate and main body portion being of substantially the same composition, e) said means joining the periphery of the face plate to said main body portion consisting of welding extending in a loop, f) said head having a top wall, a bottom wall, a toe and a heel, and said loop characterized by at least one of the following:

i) projects toward and closer to said top wall than to said toe ii) projects toward and closer to said bottom wall than to said toe iii) projects toward and closer to said top wall than to said heel iv) projects toward and closer to said bottom wall than to said heel.

11. The club head of claim 10 wherein said loop is characterized by at least two of the following:

i) projects toward and closer to said top wall than to said toe ii) projects toward and closer to said bottom wall than to said toe iii) projects toward and closer to said top wall than to said heel iv) projects toward and closer to said bottom wall than to said heel.

12. The club head of claim 10 wherein said loop is characterized by at least three of the following:

i) projects toward and closer to said top wall than to said toe ii) projects toward and closer to said bottom wall than to said toe iii) projects toward and closer to said top wall than to said heel iv) projects toward and closer to said bottom wall than to said heel.

13. The club head of claim 10 wherein said loop is characterized by all of the following:

i) projects toward and closer to said top wall than to said toe ii) projects toward and closer to said bottom wall than to said toe iii) projects toward and closer to said top wall than to said heel iv) projects toward and closer to said bottom wall than to said heel.

14. The club head of claim 10 wherein said loop projects upwardly toward said top wall.

15. The club head of claim 10 wherein said loop is polygonal.

16. The club head of claim 10 wherein said loop is trapezoidal.

17. The golf club head of claim 10 wherein the forged face plate extends to the bottom level of the head and defines a lowermost front edge portion of the head to strike the turf during golf ball striking movement of the head.

18. A golf club head, comprising a) a main body portion formed by an investment casting of a first metallic material, b) a face plate formed of a second metallic material which is forged and is substantially softer than said first material, c) means joining the periphery of the face plate to said main body portion to form a high strength, forged face plate for said golf club head, d) the metallic materials for said face plate and main body portion being of substantially the same composition, e) said periphery of the face plate extending in a loop, f) said means joining the periphery of the face plate to said main body portion consisting of welding extending in a loop.

19. The club head of claim 18 wherein said loop is characterized by at least two of the following:

i) projects toward and closer to said top wall than to said toe ii) projects toward and closer to said bottom wall than to said toe iii) projects toward and closer to said top wall than to said heel iv) projects toward and closer to said bottom wall than to said heel.

20. The club head of claim 18 wherein said loop is characterized by at least three of the following:

i) projects toward and closer to said top wall than to said toe ii) projects toward and closer to said bottom wall than to said toe iii) projects toward and closer to said top wall than to said heel iv) projects toward and closer to said bottom wall than to said heel.

21. The club head of claim 18 wherein said loop is characterized by all of the following:

i) projects toward and closer to said top wall than to said toe ii) projects toward and closer to said bottom wall than to said toe iii) projects toward and closer to said top wall than to said heel iv) projects toward and closer to said bottom wall than to said heel.

22. The golf club head of claim 21 wherein the welding extending closer to the bottom wall than to the toe is offset rearwardly from a lowermost front edge defined by the forged face plate.

23. The club head of claim 18 wherein said loop is polygonal.

24. The club head of claim 18 wherein said loop is substantially trapezoidal.

25. The golf club head of claim 18 wherein the forged face plate extends to the bottom level of the head and defines a lowermost front edge portion of the head to strike the turf during golf ball striking movement of the head.

26. A golf club head having a heel and toe and comprising:

a) a main body portion formed by a steel casting, b) a face plate formed of forged steel, and having a periphery, and c) weld means joining said periphery of said face plate to said main body portion to form a high strength, forged face plate for said golf club head, d) said main body portion having a recessed portion into which the periphery of the face plate is fitted, said weld means joining said face plate to said main body portion comprising weld joint structure formed along the periphery of said face plate and welding said face plate periphery to said recessed portion, and said weld means extending along the periphery of the face plate in looping configuration, and said weld means and face plate extending substantially to the bottom level of the head, and toward the toe and heel of the head, e) said face plate having generally trapezoidal configuration, with top and bottom elongated extents; the top extent projecting upwardly, and the bottom extent projecting downwardly.

27. The golf club head of claim 26 wherein said main body portion forms ledge means supporting peripheral portions of said face plate.

28. The golf club head of claim 27 wherein said ledge means includes a first ledge proximate the toe and extending upright from the bottom level of the head into proximity with the top level of the head, a second ledge proximate the heel and extending upright from the bottom level of the head into proximity with the top level of the head, and a third ledge proximate the top level of the head and extending generally parallel thereto and toward uppermost extents of the first and second ledges.

29. The golf club head of claim 28 wherein said first and second ledges extend lengthwise generally parallel, the first ledge substantially longer than the second ledge.

30. The golf club head of claim 26 wherein the forged face plate extends to the bottom level of the head and defines a lowermost front edge portion of the head to strike the turf during golf ball striking movement of the head.

31. A golf club head having a heel and toe and comprising:

a) a main body portion formed by a steel casting, b) a face plate formed of forged steel, and having a periphery, and c) weld means joining said periphery of said face plate to said main body portion to form a high strength, forged face plate for said golf club head, d) said main body portion having a recessed portion into which the periphery of the face plate is fitted, said weld means joining said face plate to said main body portion comprising weld joint structure formed along the periphery of said face plate and welding said face plate periphery to said portion, and said weld means extending along the periphery of the face plate in looping configuration, and said weld means and face plate extending substantially to the bottom level of the head, and toward the toe and heel of the head, e) said weld means having generally trapezoidal configuration, with top and bottom elongated extents; the top extent projecting upwardly and the bottom extent being downwardly convex.

32. A golf club head comprising:

a) a main body portion formed by an investment casting of a first metallic material, b) a face plate formed of a second material which is forged and is substantially softer than said first material, and c) means including looping welding joining the periphery of said face plate to said main body portion to form a high strength, forged face plate for said golf club head, d) the forged face plate defines a lowermost forward edge of the club head.

33. The golf club head of claim 32 wherein said second forged material is forged steel, and said first cast material is a material selected from the group consisting of steel, beryllium copper, and aluminum.

34. A golf club head comprising:

a) a main body portion formed by an investment casting of a first metallic material, b) a face plate formed of a second material which is forged, and c) means including looping welding joining the periphery of said face plate to said main body portion to form a high strength, forged face plate for said golf club head, d) the forged face plate defining a lowermost forward edge of the club head, e) at least one of said first and second metallic materials selected from the group consisting of steel, beryllium cooper, titanium and aluminum, and related alloys.

35. A golf club head comprising:

a) a main body portion formed by an investment casting of a first metallic material, b) a face plate formed of a second material which is forged, and c) means including looping welding joining the periphery of said face plate to said main body portion to form a high strength, forged face plate for said golf club head, d) the club head having a lowermost forward edge and the forged face plate extending proximate said lowermost forward edge of the club head.

36. A golf club head comprising:

a) a main body portion formed by an investment casting of a first metallic material, b) a face plate formed of a second material which is forged and is substantially softer than said first material, and c) means including looping welding joining the periphery of said face plate to said main body portion to form a high strength, forged face plate for said golf club head, d) the club head having a lowermost forward edge and the forged face plate extending proximate said lowermost forward edge of the club head, e) at least one of said first and second metallic materials selected from the group consisting of steel, beryllium copper, titanium and aluminum, and alloys thereof.

37. A golf club head comprising:

a) a main body portion formed by an investment casting of a first metallic material, b) a face plate formed of a second material which is forged and is substantially softer than said first material, and c) means including looping welding joining the periphery of said face plate to said main body portion to form a high strength, forged face plate for said golf club head, d) at least one of said first and second metallic materials selected from the group consisting of steel, beryllium cooper, titanium and aluminum.

* * * * *